US005749793A

United States Patent [19]

Lucetti

[11] Patent Number: 5,749,793

[45] Date of Patent: May 12, 1998

[54] MONOLITHIC PEBBLE HEAD GOLF CLUB

[75] Inventor: Joseph J. Lucetti, Escondido, Calif.

[73] Assignee: Chad A. Emarine, Escondido, Calif.

[21] Appl. No.: 746,912

[22] Filed: Nov. 19, 1996

Related U.S. Application Data

[63] Continuation-in-part of Ser. No. 692,799, Jul. 30, 1996.

[51] Int. Cl.[6] ..... A63B 53/04

[52] U.S. Cl. ..... 473/324; 473/313; 473/314; 473/328; 473/340

[58] Field of Search ..... 473/324, 325, 473/326, 327, 328, 329, 330, 331–350, 282, 287–292, 219, 250; 273/DIG. 14, 313, 314

[56] References Cited

U.S. PATENT DOCUMENTS

| | | | |
|---|---|---|---|
| 1,454,267 | 5/1923 | Challis et al. | 273/DIG. 14 |
| 2,121,295 | 6/1938 | Jennings | 273/DIG. 14 |
| 3,199,872 | 8/1965 | Taylor | 473/313 |
| 4,181,305 | 1/1980 | Jepson . | |
| 4,569,524 | 2/1986 | Quijano . | |
| 4,792,140 | 12/1988 | Yamagichi et al. . | |
| 5,340,107 | 8/1994 | Baker et al. . | |
| 5,405,137 | 4/1995 | Vincent et al. . | |
| 5,467,989 | 11/1995 | Good et al. | 273/DIG. 14 |

*Primary Examiner*—Sebastiano Passaniti

*Attorney, Agent, or Firm*—Henri J.A. Charmasson; John D. Buchaca

[57] ABSTRACT

A golf putter having a monolithic head consisting of a section of a composite intrusive igneous rock having a generally ellipsoidal flattened shape that has been sliced diagonally. The top of the section is drilled to receive the bottom end of the club shaft.

11 Claims, 4 Drawing Sheets

MONOLITHIC PEBBLE HEAD GOLF CLUB

PRIOR APPLICATION

This is a continuation-in-part of copending application Ser. No. 08/692,799 filed Jul. 30, 1996.

FIELD OF THE INVENTION

This invention relates to sporting goods, and more particularly to golf clubs.

BACKGROUND OF THE INVENTION

Improved putting accuracy is always the primary goal of a golfer. When one considers that at over 3 meters (10 feet) a directional error of only 6 degrees causes the ball to miss the cup, it is no wonder that a great deal of efforts have been spent toward improving the quality of golf putters. One improvement has been the addition of rails or runners to the sole of the putter for allowing the putter to glide over the green surface without the lower edge of the face of the putter catching on the grass or turf, as disclosed in U.S. Pat. No. 1,531,821 Scott. This improvement was carried over to other clubs such as woods as disclosed in U.S. Pat. No. 4,332,386 Crow. Spherical protrusions, rather than runners or rails, have also been used for the same purpose and for increasing the weight and kinetic energy that accumulates in the putter as disclosed in U.S. Pat. No. 5,286,027 Koumarianos. In spite of the above-described and other improvements, the prior art has not adequately addressed one of the most contributory causes to putting inaccuracy, the instability of the putter. Instability and directional error often result from oscillation or vibration of the putter at the instant it hits the ball.

It has been discovered that instability is contributed by vibration caused by a misalignment of the center of gravity of the putter itself with the striking point on the forward face of the putter with the ball. Such a mismatch causes a torquing force to develop between the center of gravity of the putter and the striking point. This force must necessarily be dissipated by a slight movement of the putter. The higher the weight of the putter head, the more significant becomes the induced vibrations to the point that a misalignment of a few millimeters can result in enough vibration to misdirect the ball by several degrees.

Vibrations in a putter or any other type of golf club may also be due to the elasticity of the head material. Heads made of metal are particularly prone to vibrate upon impact with the ball. This problem has been partially palliated by using materials of lesser elasticity than most metals such as man-made ceramics as disclosed in U.S. Pat. No. 5,340,107 Baker et al. Hardness of the striking surface has also been improved by lining it with a section of rock material as shown in U.S. Pat. No. 4,569,524 Quijano C. and U.S. Pat. No. 4,181,306 Jepson.

SUMMARY OF THE INVENTION

The principal object of this invention is to improve the stability of golf clubs, and more specifically, to reduce or completely eliminate vibrations caused by the impact with the golf ball. It is another object of this invention to provide a putter that can be positioned and moved very accurately in a gliding contact with the surface of the putting green so as to align the center of gravity of the putter with its striking zone and the center of gravity of the ball for more stable and accurate putts.

An additional object of this invention is to reduce the elasticity of a golf club head while giving it a more aesthetically attractive look.

These and other valuable objects are achieved by adding a pair of spacing rails projecting from the sole of the putter toward the ground surface. The spacers have a generally oblong shape with longitudinal axes in the direction of strike. Their beveled or tapered front and back ends provide for easy gliding over the grass surface. The combined center of gravity of the putter head and spacer is positioned substantially within the same plane as the equator of the ball and the striking zone on the face of the putter so as to minimize any disrupting vibration of the putter upon impact.

The look and hardness of putters as well as other types of golf clubs is also improved by making the entire head out of a section of beach pebble material that has been ground to a smooth ellipsoidal shape by abrasion against other similar pebbles under the long and constant action of the surf.

DESCRIPTION OF THE PREFERRED EMBODIMENTS OF THE INVENTION

Figure 1:
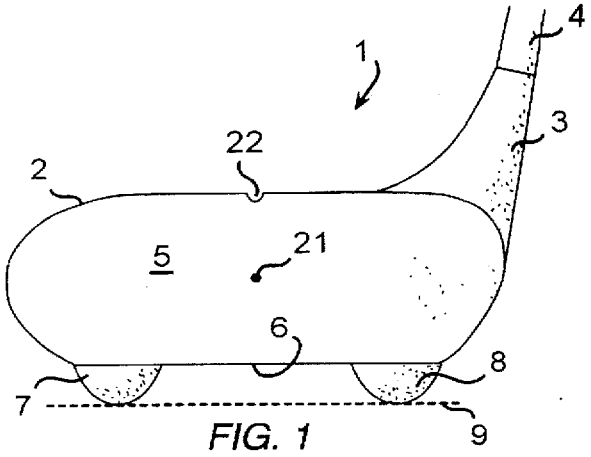
FIG. 1 is a front elevational view of a putter according to the invention.
Figure 2:
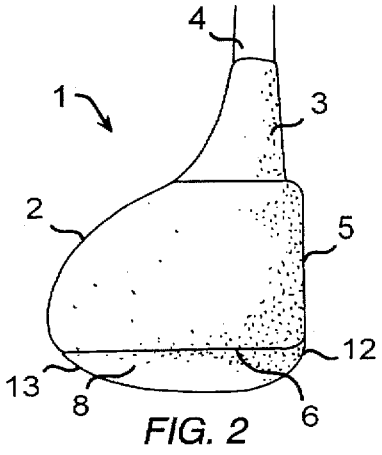
FIG. 2 is a outer side view thereof.
Figure 3:
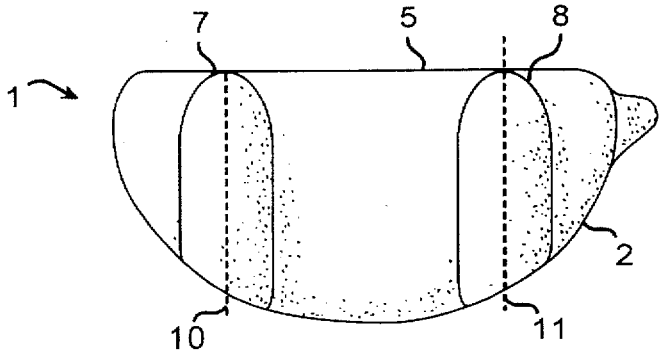
FIG. 3 is a bottom plan view thereof.

Referring now to the drawing, there is shown an improved putter 1 whose head 2 extends upwardly into a hosel 3 for receiving a shaft 4. The head has a flat and substantially vertical front face 5 to which may be imparted a slight left of about 5 degrees from the vertical as it is customarily done to compensate for any misalignment at the time of strike that could drive the ball toward the ground. Projecting downwardly from the undersurface 6 of the head, are two parallel and spaced apart spacers which extend downwardly to a ground plane 9 parallel to the undersurface 6 and substantially perpendicular to the front face 5. The spacers 7, 8 are oblong and have their longitudinally axes perpendicular to the front face 5. The spacers have a substantially semicircular median cross-section. Their forward bottom ends taper up toward the undersurface 6, and their backward ends 13 taper up over approximately half the length of the spacers toward the undersurface 6. The rounded and tapered shape of the spacers are designed for easy gliding over the turf surface of the green while offering very little resistance to the movement of the head toward the ball.

Figure 4:
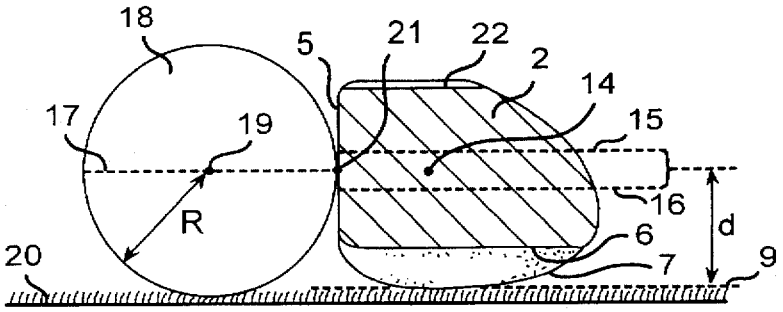
FIG. 4 is a diagram of the relative positions of the golf ball, putter head and the surface of the green at the striking time.

As more specifically illustrated in the diagram of FIG. 4, the center of gravity 14 of the combined head and spacers is positioned within a range delineated by two horizontal level planes 15, 16 within which lies also the equatorial line 17 of the ball 18 and the ball's center of gravity 19. Accordingly, the vertical distance between the center of gravity 14 of the head and the ground plane 9 corresponding to the base of the spacers is approximately equal to the radius R of the ball. Taking into account the fact that at the striking time the ground plane 9 is slightly above the actual ground surface 20 upon which the ball rests, it has been determined that the upper limit constituted by the plane 15 at which the center of gravity of the head 14 can be positioned is approximately R plus 3 millimeters, and that the lower limit constituted by the lower plane 16 is R minus 9 millimeters measured from the ground plane 9.

For added stability and accuracy, it is critical that the striking point 21 on the front face of the head be also lined up horizontally with the center of gravity 14. To that purpose, a front to back groove 22 is cut into the top of the head immediately above the center of gravity in order to facilitate alignment.

The alignment of the putter head and ball center of gravity can also be achieved by appropriately distributing the weight of the head without using any spacer. In such a case the distance d is measured vertically from the lowermost point on the undersurface of the head.

It should be understood that the shape of the putter head illustrated in connection with this preferred embodiment of the invention is not critical, and that the invention can be adapted to a great variety of putter head configurations. Such adaptation may require the use of a different number of spacers. The positioning of the spacers may also have to be changed in order to position the putter in the exact desired location when it rests lightly on the ground near the ball before striking. The spacers can be made integrally of the same material as the head, and their weight can be conveniently adjusted to bring the center of gravity of the structure to the desired height. For instance, the spacers can be tubular, or made hollow initially then injected with the necessary weighting material to make such an adjustment. The cross-section of the spacer may be narrowed in order to minimize the drag against the ground surface. However, the preferred embodiment disclosed above is thought to be the best compromise between various critical factors including sturdiness, stability and ease of fabrication.

Figure 5:
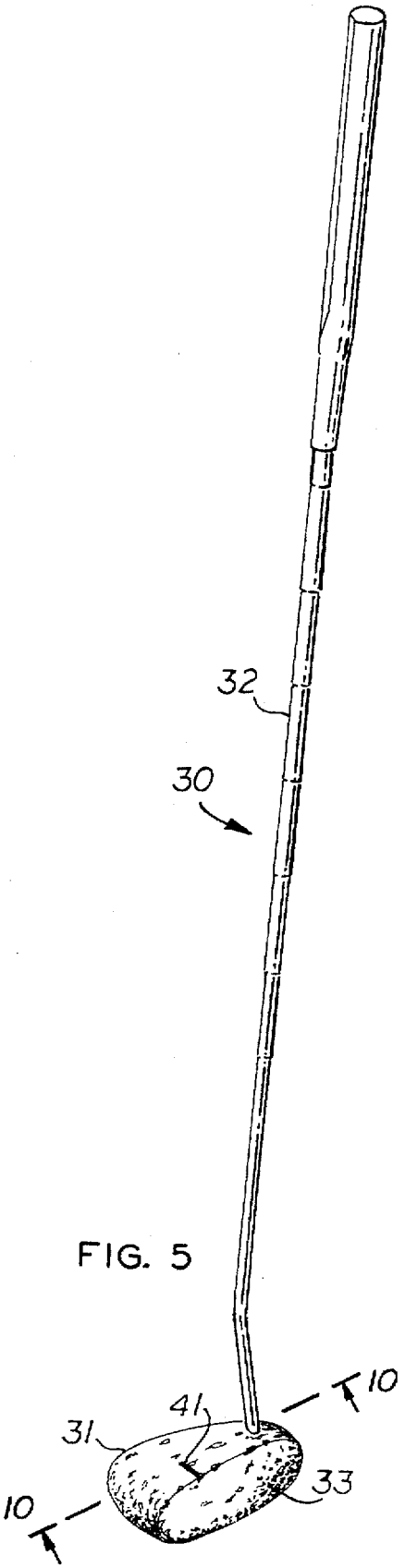
FIG. 5 is a front, top and right side perspective view of a monolithic pebble-head golf club according to the invention.
Figure 6:
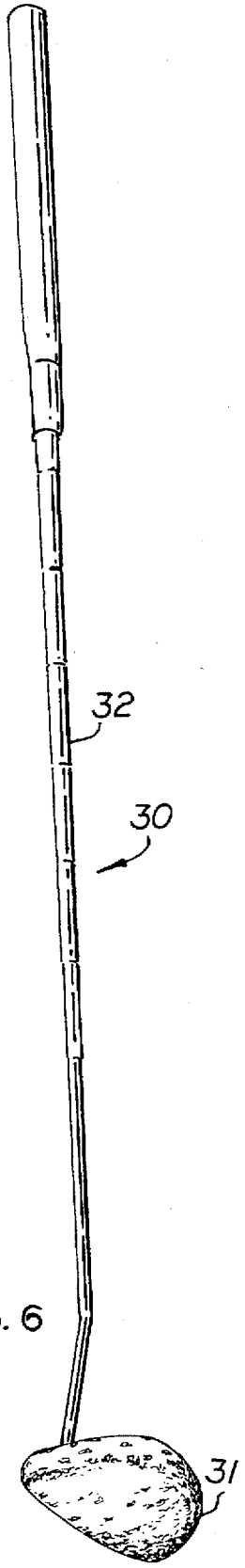
FIG. 6 is a back, bottom and left side perspective view thereof.

Referring now to FIGS. 5 and 6, there is shown a golf club 30 comprising a head 31 and a shaft 32. The head consists of a monolithic section of a beach pebble, and comprises a striking face 33 that lies in a substantially vertical plane, although in some clubs the striking face may have a loft of a few degrees.

Figure 8:
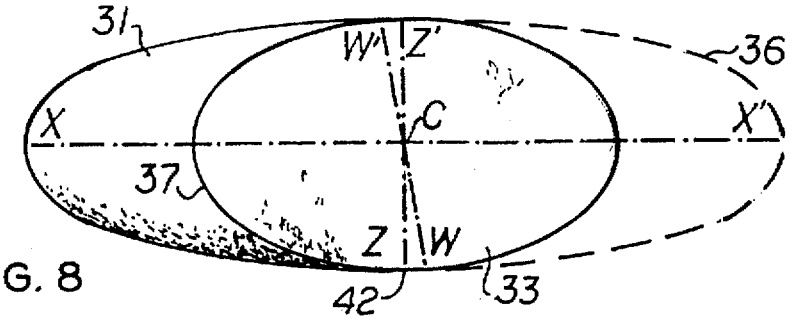
FIG. 8 is a front elevational view thereof.
Figure 7:
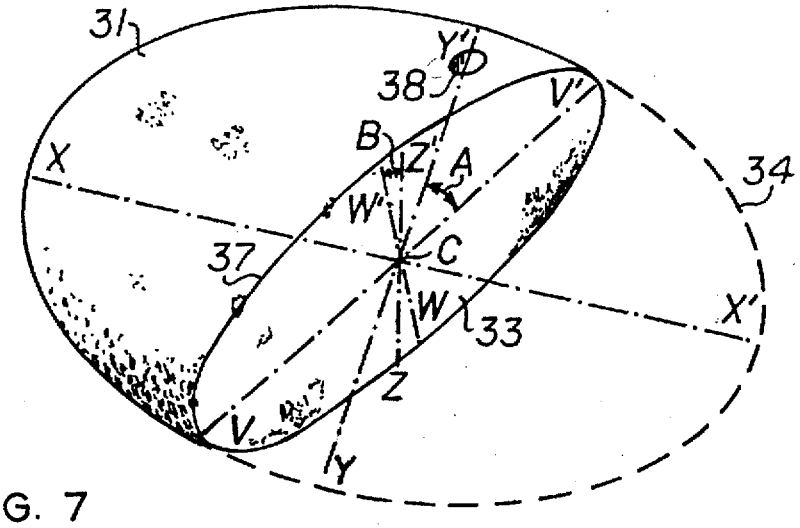
FIG. 7 is a front, top and left side perspective view of the pebble-head.
Figure 9:
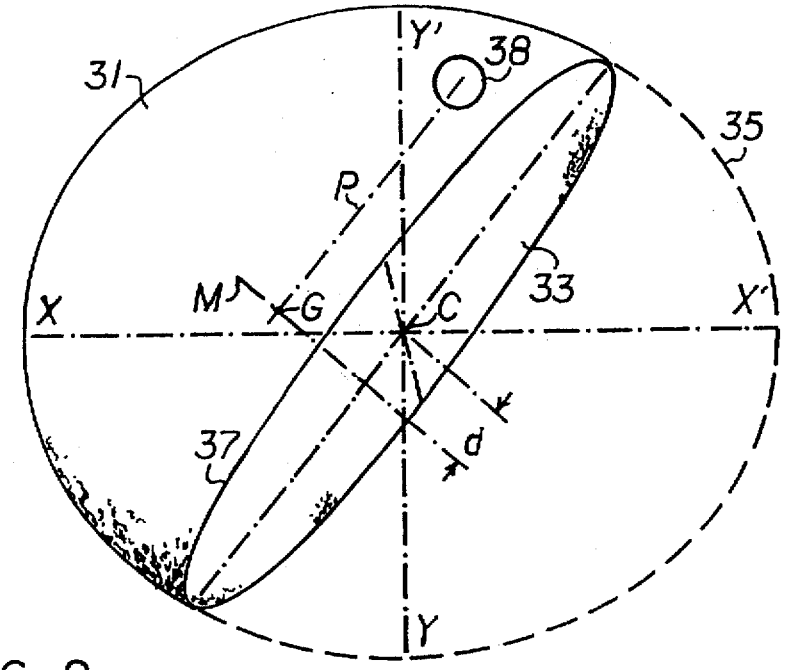
FIG. 9 is a top plan view thereof.

As illustrated in FIGS. 7–9 the head 31 is made from a beach pebble 34 whose cast out portion is shown in dotted line. The beach pebble is preferably one having a general flattened, ellipsoidal shape. Beach pebbles of composite intrusive igneous rock are preferred due to their resistance to chipping and their smooth and near symmetrical shape achieved by long grinding against other pebbles under the action of the surf. This type of beach pebble has a modulus of longitudinal elasticity lower than steel and is practically immune to vibrations when stricken.

Thus, a beach pebble 24, with a median, horizontal cross-section lying in a plane defined by the perpendicular axes X–X' and Y–Y', has an outline or periphery generally defining an ellipse within a range of from about 50 to about 70 degrees. The median vertical cross-section of the pebble lying within a plane defined by axes X–X' and Z–Z' has a periphery generally defining an ellipse preferably in the range from about 15 to about 30 degrees. The pebble is sliced into two approximately symmetrical halves along a third plane defined by horizontal axis V–V' and vertical axis W–W'. All the above mentioned axes intersect at the same point C at the center of the pebble. The slicing plane is diagonal in relation to the general elliptical form of the pebble as defined by an angle A between axes Y–Y' and V–V' which is between about 20 and about 40 degrees.

The side of the pebble section exposed by the slicing constitutes the striking face 33. In some golf clubs such as a putter, the striking face is preferably vertical. In such case, axes Z–Z' and W–W' are congruent. In other clubs such as a chipper, the striking face 33 may be given a slight back loft. In which case, axis W–W' will be at an angle B of about 3 to about 10 degrees with axis Z–Z'. The periphery 37 of the striking face roughly defines an ellipse of about 15 to about 30 degrees.

Figure 10:
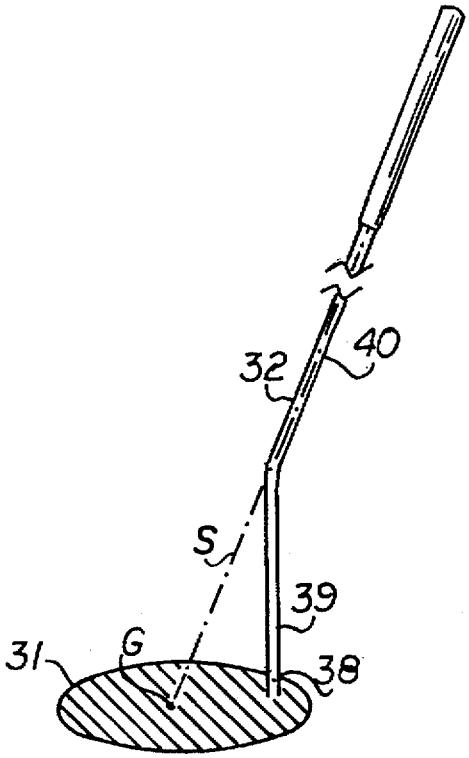
FIG. 10 is a cross-sectional view taken along line 10—10 of FIG. 5.

A hole 38 is drilled vertically into the upper surface of the head along a plane parallel to the long axis V–V' of the striking face and containing the center of gravity G of the head. As illustrated in FIG. 10, the shaft 32 has a first short lower section 39 with a lower end secured into the hole 38. A longer section 40 of the shaft is inclined along an axis S that passes through the center of gravity G of the head. It should be noted that a line M passing through the center of gravity G and intersecting the long axis V–V' of the striking face at a right angle is located a short distance d from the center C of the striking face and in an area opposite the shaft in relationship to said center C. This is due to the asymmetrical shape of the head resulting from the diagonal slicing of the pebble. A small linear mark 41 is placed on the top surface of the pebble just above the line M passing through the center of gravity C in order to facilitate the alignment of the head center of gravity with the ball. The vertical alignment of the center of gravity in relationship to the equator of the ball results from keeping the short vertical axis Z–Z' of the striking face to a distance roughly equal to the diameter of the ball. Thus, for a standard golf ball having a radius R of about 2. 14 centimeters, the median horizontal plane X–X', Y–Y' should be at a distance from the lowest most point 42 of the head of between about 1.5 to about 2.8 centimeters; that is R plus or minus 0.66 centimeter. The total weight of the monolithic head 31 may vary between 300 and 400 grams.

It must be understood that beach pebbles have shapes that seldom fit exact geometrical figures. They are rarely symmetrical. The ones selected for the fabrication of the heads in the instant invention are preferably within plus or minus about 10 percent of the idealized ellipsoidal shapes above described.

Figure 11:
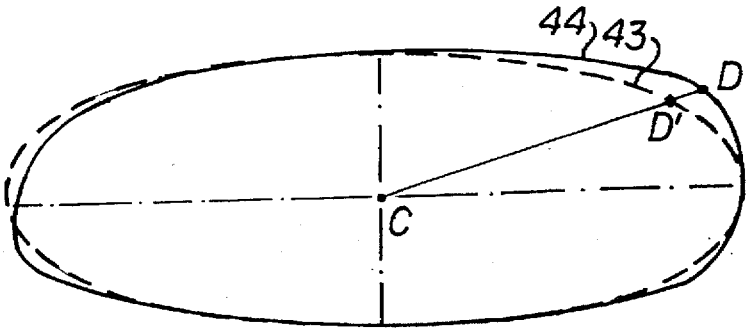
FIG. 11 is a diagrammatical illustration of the worst case deviation from a perfect ellipse of the striking face outline.

In FIG. 11, a perfect 20 degree ellipse 42 is shown in dotted lines superimposed over the actual outline 44 of the striking face of a club head according to the invention. At a point D of worst case deviation of the outline from the perfect ellipse, the distance CD from the center C of the ellipse does not exceed the ideal distance CD' by more than 10 percent.

Figure 12:
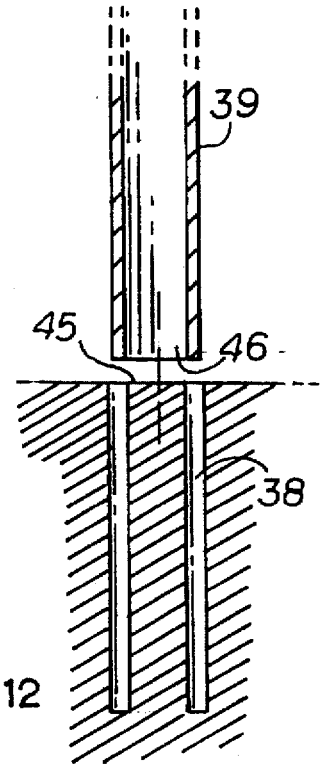
FIG. 12 is a partial cross-sectional view of the head illustrating the shaft attachment.

The attachment of the lower end 39 of the shaft to the head 31 is illustrated in FIG. 12. In order to achieve a stable and permanent bond, the hole 38 is bored into the upper surface of the head with a circular bit, leaving intact a central plug 45. The tubular end 46 of the shaft is engaged over the plug and secured in the hole with an epoxy adhesive.

The definitions of the ellipses given herein in degrees refer to the conventional manner of defining the shape of an ellipse as a projection of a circle over an oblique plane from a vanishing point on the axis of the circle. The degrees indicate the angle of the projecting plane with the axis of the circle; according to which the shape of the ellipse approaches that of a circle as the angle of projection nears 90 degrees.

While the preferred embodiments of the invention have been described, modifications can be made and other embodiments may be devised without departing from the spirit of the invention and the scope of the appended claims.

What is claimed is:

1. A golf club which comprises:

a section of natural composite intrusive igneous forming a monolithic striking head, and having a substantially flat lateral striking face and a hole drilled into a top surface section; and, a shaft having a lower end secured into said hole.

2. The golf club of claim 1, wherein said striking face has a periphery substantially defining a first ellipse, wherein said first ellipse has a center and long axis passing through said center, and said long axis lies in a substantially horizontal first plane.

3. The golf club of claim 2, wherein said horizontal first plane lies within a range of approximately 1.5 to approximately 2.8 centimeters from a lowermost point on said periphery.

4. The golf club of claim 3, wherein a cross-section of said section of composite intrusive igneous rock taken about said horizontal first plane has a second periphery substantially defining a section of a second ellipse, wherein said second ellipse has a short axis and a long axis.

5. The golf club of claim 4, wherein said second ellipse falls within a range of approximately 50 to approximately 70 degrees.

6. The golf club of claim 5, wherein said section of said second ellipse has a rectilinear side lying in a second plane intersecting said short axis of said second ellipse at an angle of between approximately 20 to approximately 40 degrees.

7. The golf club of claim 6, wherein said rectilinear side has a median point congruent with the center of said first ellipse.

8. The golf club of claim 6, wherein said shaft lies in a third plane substantially parallel to said rectilinear side.

9. The golf club of claim 8, wherein said shaft has a proximal lower portion including said lower end secured in said hole, and a longer distal portion lying along an axis orthogonally intersecting a line lying within said second ellipse perpendicular to the long axis of said first ellipse.

10. The golf club of claim 9, wherein said monolithic head has a center of gravity approximately located at the intersection of said line and shaft axis.

11. The golf club of claim 2, having a monolithic head consisting of said section of composite intrusive igneous rock.

* * * * *